United States Patent [19]

Ardrey

[11] 4,241,376

[45] Dec. 23, 1980

[54] SYSTEM FOR AUTOMATICALLY SELECTING OPERATIONS IN A RANDOM SEQUENTIAL MANNER

[75] Inventor: Richard J. Ardrey, Nashville, Tenn.

[73] Assignee: PhotoScan South, Inc., Nashville, Tenn.

[21] Appl. No.: 40,684

[22] Filed: May 21, 1979

[51] Int. Cl.[3] ..... H01H 47/32

[52] U.S. Cl. ..... 361/166; 361/191; 361/192; 361/197

[58] Field of Search ..... 361/166, 191, 192, 197, 361/205; 307/41; 315/200 A, 226, 322

*Primary Examiner*—Harry E. Moose, Jr.
*Attorney, Agent, or Firm*—Harrington A. Lackey

[57] ABSTRACT

A system for automatically selecting operations in a random sequential manner having at least three electrical channel circuits, each channel circuit including primarily a trigger circuit, a switch circuit and an output circuit. Each trigger circuit includes an electrical conductor component exhibiting a negative resistance characteristic, such as a DIAC, adapted to turn on at a relatively high voltage and turn off at a lower voltage, each trigger circuit including a timer circuit for turning on and off the respective electrical conductor components, but all of the timer circuits having different time constants. The different switch circuits are adapted to be turned on by the signals from the corresponding trigger circuits and are adapted to be turned off by corresponding switch timer circuits, also preferably having time constants with different values.

Resultant output signals produced one at a time and in random sequence are adapted to control various operations, such as the scanning of a plurality of closed circuit television cameras, such as used in surveillance systems.

10 Claims, 1 Drawing Figure

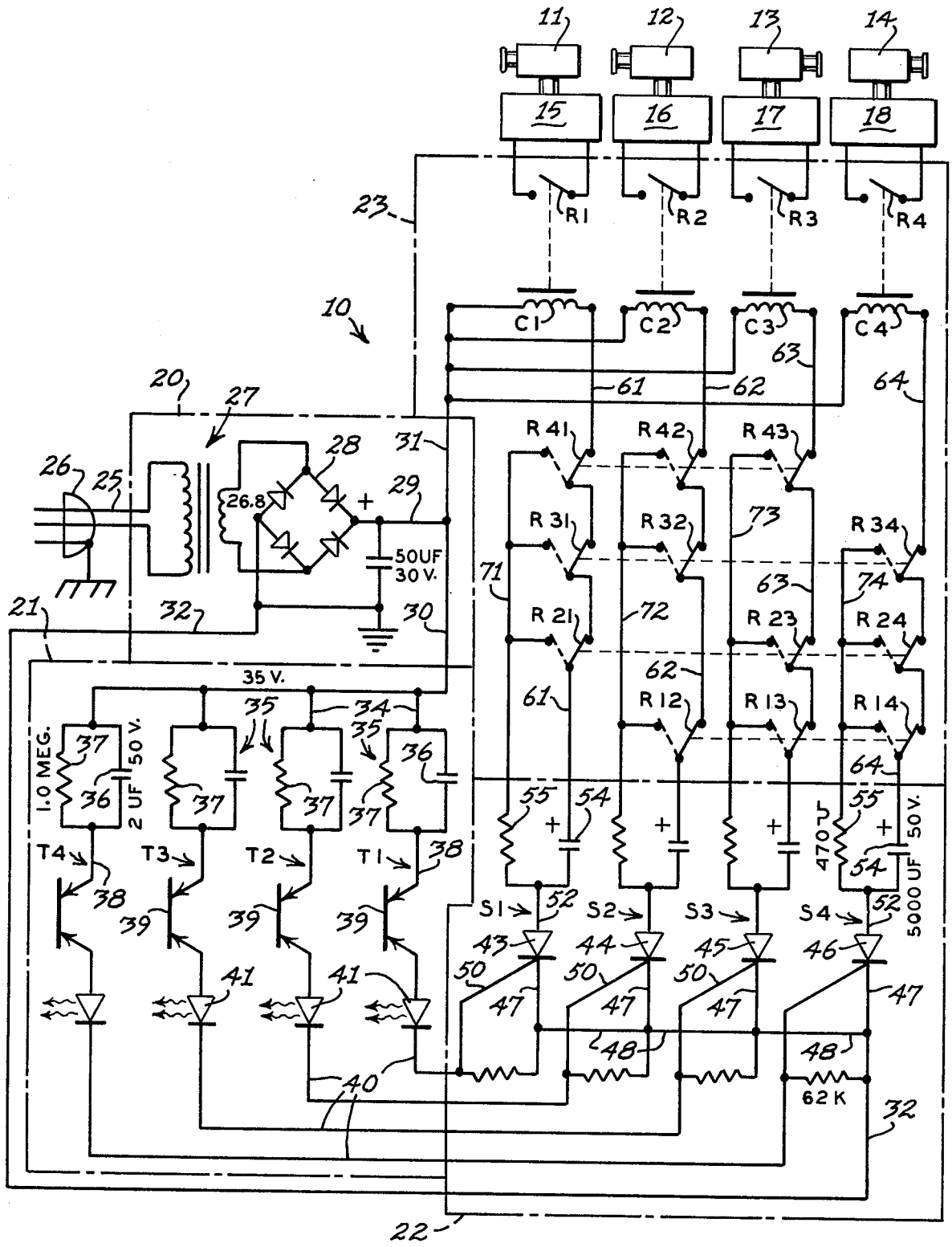
11
12
13
14
15
16
17
18
R1
R2
R3
R4
23
10
C1
C2
C3
C4
63
61
62
64
20
27
28
31
26
25
26.8
29
50UF
30 V.
R41
R42
R43
R31
R32
R34
73
71
74
R21
72
R23
R24
21
32
30
35 V.
35
34
R12
R13
R14
1.0 MEG.
37
50 V.
2 UF
36
T4
T3
T2
T1
38
39
41
55
54
470 UF
50 V.
5000 UF
S1
S2
S3
S4
52
43
44
45
46
50
47
48
62 K
40
22

SYSTEM FOR AUTOMATICALLY SELECTING OPERATIONS IN A RANDOM SEQUENTIAL MANNER

BACKGROUND OF THE INVENTION

This invention relates to automatic electrical controls, and more particularly to automatic electrical controls for the random sequential selection of certain desired operations.

Conventionally, closed circuit television (CCTV) systems have been used in business establishments as a psychological deterrent to shop-lifting and pilferage. Deterrence is achieved by locating CCTV monitors in locations where they can be readily viewed by the public, and by the mounting of CCTV cameras which provide selected scenes of the establishment for public viewing on the monitors.

The effectiveness of such CCTV cameras surveillance systems tends to diminish as time passes, and has been improved somewhat in some installations by providing rotational capability to the camera housings for horizontal scanning and operating it by remote control from a monitoring station. When only manual, such remote control is normally prohibitively expensive in terms of labor. When automated, the remote control has consisted only in an obviously automatic scanning arrangement in which the camera housings oscillate between stops at the ends of a preset horizontal arc either in steps or in uninterrupted travel through the span of the arc as described in U.S. Pat. No. 3,535,442. Such a system, although superior to one having static camera housings, has predictable aspects and hence also diminishes in effectiveness as time passes.

The object of the present invention is to substantially improve the effectiveness of a CCTV camera surveillance system by providing automatic random sequential scanning capabilities.

It is also an object of this invention to provide an automatic control system for producing any type of random sequential operation.

SUMMARY OF THE INVENTION

The apparatus made in accordance with this invention must include at least three electrical channel circuits to provide completely random and sequential operations.

Each channel circuit comprises a trigger circuit and power supply means for impressing an input voltage across the trigger circuit. Each trigger circuit includes a timer element or circuit including a resistor and capacitor in parallel and an electrical conductor component which exhibits a negative resistance characteristic, such as a bilateral trigger diode, DIAC, or even a neon lamp.

Initially when a voltage is applied across a trigger circuit, the electrical conductor component immediately conducts, while the capacitor in the RC timer circuit commences to charge. As the voltage increases across the capacitor, the voltage decreases across the electrical conductor component until the component ceases to conduct. At that point, the capacitor discharges back through the resistor in the timing circuit. As the voltage decreases across the capacitor, voltage increases across the conductor component, until the conductor component again conducts.

Even though the resistors and capacitors used in the timer elements of the trigger circuits may have identical ratings or nominal values, nevertheless the actual time constants of the various timer elements are different from each other because of the impossibility, under current technology, of manufacturing any two resistors or capacitors exactly alike. Accordingly, the electrical conductor components conduct and turn off at different non-uniform times and sequences.

The resultant trigger signals from these trigger circuits are employed to control actuator switches, such as SCRs, in a corresponding number of switch circuits. Each switch circuit comprises a switch timer element, including a capacitor, exhibiting a different time constant from the other switch timer elements, which normally operate to maintain the conductance of its corresponding SCR, after being biased by a trigger signal, for a predetermined period.

Each channel circuit preferably has in its output circuit a relay coil connected in series with the capacitor in each switch timer element, which, when energized, actuates an output relay switch for controlling a certain operation for each channel circuit, such as the scanning movements of a CCTV camera.

In order to improve the random effect and to permit only one operation to be conducted at one time, each output circuit, including the relay coil and timer capacitor, is provided with a plurality of interruptable interlock switches, each switch being controlled by one of the relay coils in each of the other corresponding channels. These interlock relay switches, when actuated by the energized relay coil in one active output circuit, close a return circuit to the resistor in each of the switch circuits in the inactive output circuits, in order to permit rapid bleeding or discharging of the capacitor in the inactive output circuits to reset the inactive switch circuits and also to discontinue the operation of any output circuit, except the single active output circuit.

The result is the completely random, but sequential, selection of one operation at a time from a plurality of desired operations, such as the sequencing of scanning operations of a plurality of closed circuit television cameras.

BRIEF DESCRIPTION OF THE DRAWINGS

The single FIGURE is an electrical schematic circuit diagram of the automatic control system made in accordance with this invention.

DESCRIPTION OF THE PREFERRED EMBODIMENTS

The drawing discloses an electronic circuit diagram of the system 10, made in accordance with this invention, for automatically selecting certain operations in a random sequential manner. As disclosed in the drawing, the system 10 is controlling four closed circuit television (CCTV) cameras 11, 12, 13 and 14 through their respective scanning control mechanisms or devices 15, 16, 17 and 18, which, when actuated, cause the respective cameras 11–14 to rotate, or oscillate, or pan back and fourth, to scan certain areas under surveillance.

Basically, the system 10 includes a power supply circuit 20, trigger circuit system 21, actuator switch circuit system 22, and output circuit system 23.

The power supply circuit 20 includes a supply input line 25 having a plug 26 for engagement with a power supply receptacle, not shown, of 120 volts AC. The input line 25 is connected to a transformer 27 which steps down the voltage for transmission through a rectifier in the form of a bridge 28 in order to supply DC voltage and current through input line 29 to branch trigger input line 30 and to branch line 31 for supplying power to the output circuit system 23. The output side of the bridge 28 is connected to the grounded line 32 from the switch circuit system 22.

In order to effect a random control, there must be at least three channels in the system 10. As disclosed in the drawing, since there are 4 TV cameras 11–14, then there must be 4 channel circuits throughout the system 10, one channel circuit for controlling each camera control mechanism 15–18.

In the trigger circuit system 21, there are four trigger circuits T1, T2, T3 and T4. Each trigger circuit, such as T1, has the same circuit configuration, including an input line 34, a timer element or circuit 35, including a capacitor 36 and a resistor 37 connected in parallel. A connector lead 38 connects the timer element 35 to an electrical conductor component exhibiting a negative resistance characteristic, such as DIAC 39, in series. The trigger signal line 40 from DIAC 39 may also include a pilot or trouble lamp in the form of an LED 41.

All of the components, such as the capacitor 36, resistor 37 and DIAC 39 may be substantially identical to the corresponding elements in the other trigger circuits T2, T3 and T4, having the same nominal values.

However, it is virtually impossible to manufacture any two electrical or electronic components, such as capacitors and resistors, even of the same nominal values, to have identical electrical values. It is such inexact properties which lend themselves to effecting the random selection of operations which is the purpose of this invention.

In the switch circuit system 22 are four switch circuits S1, S2, S3 and S4 corresponding to the four channels of the electrical system 10. In each of the switch circuits S1–S4 is an actuator switch, in the form of an SCR 43, 44, 45 and 46. One side of each of the SCRs is grounded through lines 47 and connector lines 48 to the grounded line 32. Each of the biasing leads 50 to the respective SCRs 43–46 is connected directly to the respective trigger signal lines 40 in the corresponding trigger circuits T1–T4.

The other side of each of the SCRs 43–46 is connected through a lead 52 to a capacitor 54 and resistor 55 connected in parallel.

In switch circuit S1, the capacitor 54 is connected through a relay output circuit 61 to a relay coil C1. In a similar manner, relay output circuits 62, 63, and 64 connect the respective capacitors 54 to their respective coils C2, C3 and C4. The opposite sides of the coils C1–C4 are supplied with power through the input line 31.

The capacitor 54 and the relay coils C1–C4 in each output circuit 61–64, constitute the timer element or timer circuit for the corresponding switch circuits S1–S4.

The capacitors 54 and relay coils C1–C4 in each of the output circuits 61–64 may be of the same respective rated or nominal values, but because of imperfections in the materials and the inaccuracies of manufacturing, the precise values of the capacitors 54 and relay coils C1–C4 are not exactly the same, a characteristic which further supports the random operation achieved by the system 10.

Also, included in the output circuit 61 are three interlock relay switches R21, R31 and R41, each of which is respectively controlled by the respective relay coils C2, C3 and C4. Thus, the energization of any of the other coils C2, C3 and C4 will move its respective interlock relay switch R21, R31 and R41 to its corresponding dashed-line latched position disclosed in FIG. 1 to open the output circuit 61.

The alternate, phantom-line position of the interlock relay switches R21, R31 and R41 are adapted to short-circuit the capacitor 54 to the interlock return line 71 connected to the resistor 55.

The relay output circuit 62 connected to switch circuit S2 is identical to the relay output circuit 61, with the exception of the inclusion of three differently located interlock switches R12, R32, and R42, each of which is controlled respectively by one of the other relay coils C1, C3 and C4.

In the same manner, the output circuit 63 includes the three interlock switches R13, R23, and R43, respectively controlled by the relay coils C1, C2 and C4.

Likewise, in output circuit 64 connected to switch circuit S4, the interlock switches R14, R24, and R34 are controlled respectively, by the coils C1, C2 and C3.

These respective relay interlock switches in output circuits 62, 63 and 64 are adapted to connect their respective capacitors 54 to the corresponding resistors 55 through the respective interlock return lines 72, 73 and 74, as disclosed in the schematic drawing.

The coils C1, C2, C3 and C4 also directly control the output relay switches R1–R4 for actuating the respective camera control mechanisms 15, 16, 17 and 18.

The operation of the system 10 is as follows:

With the television cameras 11–14 located in their desired positions for scanning predetermined areas for surveillance, and the plug 26 inserted into a power outlet receptacle, a DC trigger input voltage, such as the designated 35 volts, is applied to the input of the trigger circuit system 21, and the same voltage is applied to the high side of the relay coils C1, C2, C3 and C4 in the output circuit system 23.

With the capacitors 36 in the timer elements 35 of the trigger circuits T1–T4 discharged, the full input voltage to the trigger circuit, such as T1, is impressed across the electronic component or DIAC 39 to energize the same. The LED 41 in the trigger circuit T1 simultaneously illuminates and an output trigger signal is transmitted from trigger circuit T1 to the bias circuit 50 of the SCR 43 in switch circuit S1. The capacitor 36 in the trigger circuit T1 commences charging, while simultaneously decreasing the voltage across the DIAC 39. When the voltage across the DIAC 31 is reduced to a low threshold value determined by the characteristic of the DIAC 39, the DIAC 39 will immediately turn off, thereby opening the trigger circuit T1. The voltage charge upon the capacitor 36 will then discharge through the resistor 37 within a period determined by the value of the resistor 37. After the voltage upon the capacitor 36 is reduced to a turn-on value, determined by the characteristic of the DIAC 39, the DIAC 39 will again conduct to close the trigger circuit T1, illuminate its LED 41, and transmit another trigger signal to the bias circuit 50 of the SCR 43 in switch circuit S1. Again, the capacitor 36 will commence recharging, and the cycle will be repeated to alternately turn on and off DIAC 39 to impress alternate bias signals upon the SCR 43.

Each of the trigger circuits T2, T3 and T4 will function in the same manner as the trigger circuits T1, to alternately turn on and off their respective DIACS 29 for producing alternate trigger signals to bias their respective SCRS 44, 45, and 46 into conduction.

Because of the differences in the time constants of the capacitors 36 and the resistors 37 in the respective trigger circuits T1–T4, the DIACs 39 will turn off and on at different times and for different time periods. This alternate energization of the DIACs 39 is comparatively rapid, and the energization periods of the DIACs may overlap. However, the energization and deenergization of the DIACs 39, as well as the periods of energization, are random activities because of the differences in the time constants of the components in the timer elements 35.

While all of the relay coils C1–C4 are deenergized, all of the interlock relay switches will be in their solid-line positions disclosed in the drawing, and all of the output relay switches R1–R4 will be open.

Assuming that at the initiation of the application of the input voltage to the system 10, all of the relay coils C1–C4 are deenergized, and further assuming that the trigger circuit T1 is the first one turned on, thereby turning on the SCR 43 first, then the switch circuit S1 will be energized or closed. With the switch circuit S1 energized, and assuming that its capacitor 54 is discharged, current will flow through the coil C1 from the input line 31 and through the relay output circuit 61 and the interlock switches R41, R31 and R21, in their solid-line positions. The switch circuit S1 will remain closed, even after the bias is removed from the SCR 43 when the trigger circuit T1 is turned off.

When the coil C1 is energized, it will simultaneously close the output switch R1 to actuate the scanning mechanism 15 to commence the scanning operation of the TV camera 11.

Also, energization of the relay coil C1 will simultaneously move the interlock switches R12, R13 and R14 to their dashed-line latched positions, which will open all of the relay output circuits 62, 63 and 64, to prevent energization of the relay coils C2, C3 and C4, so long as the relay coil C1 is energized sufficiently to hold the interlock switches R12, R13 and R14 in their latched positions.

While the relay output circuit 61 is energized, its capacitor 54 will gradually charge, simultaneously gradually reducing the current through the coil C1 and the SCR 43. As the voltage drops across the relay coil C1, it will decline below a minimum latching strength, causing the coil C1 to release the relay switch R1 and the interlock switches R12, R13, and R14. Thus, the camera 11 will cease to scan, and the output circuits 62, 63 and 64 are armed, or conditioned for energization. The next SCR 44, 45, or 46 to receive a trigger signal will conduct to energize its corresponding switch circuit S2, S3 or S4.

After the capacitor 54 in the output circuit 61 charges to a value which will cause the relay coil C1 to release its relay switches R1, R12, R13 and R14, the capacitor 54 will continue to charge, while the other armed output circuits 62, 63, and 64 wait until the next one of them is energized by its trigger signal. Even if the SCR 43 is the next SCR to receive a trigger signal, the switch circuit S1 will not be affected, because it is already in conductance and its capacitor 54 is still sufficiently charged to support only a weak current in the output circuit 61.

When the next trigger signal biases an SCR, such as the SCR 46 in switch circuit S4, then the coil C4 will be energized to immediately latch the interlock relay switches R41, R42 and R43. Thus, the movement of the interlock switch R41 from its solid-line position to its dash-line position will open, and hold open, the previously energized circuit 61 to turn off the switch circuit S1 and to discharge its capacitor 54. Thus, there can never be but one output circuit 61–64 energized at any time. Furthermore, no output circuit 61–64 can be energized immediately after it has already been energized, but can only be energized after another output circuit has been first energized.

Assuming that the SCR 46 is turned on by the next trigger signal from the trigger circuit T4, the switch circuit S4 will close to energize its relay coil C4, closing the output relay switch R4 to commence the scanning of the TV camera 14. Simultaneously, the interlock switches R41, R42 and R43 will be actuated to move to their respective dash-line latched positions, to open the other output circuits 61, 62 and 63 and render them inoperative so long as the circuit 64 is operative.

When the interlock relay switch R41 is latched by the relay coil C4, the charge remaining on the capacitor 54 in the circuit 61 is short-circuited through the return or interlock line 71 to bleed through the resistor 55 of the switch circuit S1, in order to completely discharge the corresponding capacitor 54 and condition switch circuit S1 for reenergization after it receives its next bias signal, provided that the other circuits 62, 63 and 64 are closed.

Again, because of the different or inconsistent time constants of the resistive and capacitive elements, both in the trigger circuits T1–T4 and in the output circuits 61–64, the trigger bias signals will be produced in a completely random manner and the output circuits 61–64 will be energized in a completely random manner, in unpredictable sequences, being turned on and off at different times and for different time periods. Moreover, because of the interlock relay switches, only one output circuit 61–64 at a time can be turned on. Therefore, only one camera 11–14 will be scanning at any one time, for a random period and in a random sequence with any of the other cameras.

It will be understood that other types of electrical conductor components 39 exhibiting negative resistant characteristics can be used, instead of the DIAC 39. In fact, neon lamps have been used instead of DIACs 39 in trigger circuits, such as T1–T4. However, greater voltage is required for energizing or illuminating the neon lamps.

The LEDS 41 are employed as pilot or trouble lights to indicate the energization and deenergization of the corresponding trigger circuits T1–T4, and thereby facilitate maintenance of the trigger circuit system 21.

The resistors 55 in the return lines 71–74 have lower resistive values than the resistances in the coils C1–C4, so that the capacitors 54 can discharge more rapidly than they are charged to assure that each corresponding switch circuit S1–S4 will be more rapidly restored to a condition for conducting after receiving the next trigger signal.

The time constants of the various resistors 37, relay coils C1–C4, and the capacitors 36 and 54 will vary with the aging of the various components to improve the random nature of the output signals. Moreover, the time constants of the various components may be positively varied by the employment of potentiometers, variable capacitors and other variable components.

It will be understood that other operations than the scanning operation of closed circuit television cameras for surveillance purposes can be effected with the system 10. For example, instead of cameras 11, 12, 13, and 14, lights or lamps could be substituted. Such lamps could be located at strategic points around a building or plant or home, and their individual illumination would be completely random, not only in their sequencing but also in their duration.

Other potential uses of the random selection system 10 are limited only by the imagination of the potential user.

What is claimed is:

1. A system for automatically selecting operations in a random sequential manner comprising:

(a) at least three electrical channel circuits, (b) each channel circuit comprising an input circuit, a trigger circuit and an output circuit, (c) said trigger circuit comprising a timer element and an electrical conductor component exhibiting a negative resistance characteristic connected in series with each other and said input circuit, (d) the time constants of said timer elements in different channel circuits having different values, (e) each of said electrical conductor components being adapted to conduct electricity for a period corresponding to the time constant of the corresponding timer element in the same channel circuit, to produce a corresponding trigger signal during said period, and (f) switch means operatively connected to each of said output circuits and actuable by said trigger signals to produce a resultant output signal in only one output circuit at a time in a random sequential manner.

2. The invention according to claim 1 in which said timer element comprises a resistor and a capacitor connected in parallel.

3. The invention according to claim 2 in which the capacitor in said timer element is adapted to discharge through said resistor when said electrical conductor component becomes non-conductive.

4. The invention according to claim 1 in which said electrical conductor component is a bilateral trigger diode.

5. The invention according to claim 4 in which said electrical conductor component is a DIAC.

6. The invention according to claim 4 in which said input circuit produces a maximum voltage across said trigger circuit, said bilateral trigger diode being adapted to conduct at a predetermined high voltage less than said maximum applied voltage, and to be non-conductive at a low voltage less than said high voltage.

7. The invention according to claim 1 comprising a switch timer element in each channel circuit for discontinuing a resultant output signal in said corresponding channel circuit after a period determined by the time constant of said switch timer element.

8. The invention according to claim 7 further comprising interlock switch means in said output circuits responsive to said switch timer elements to maintain only one output circuit at a time in an operative condition for producing a resultant output signal when said output circuit receives a trigger signal.

9. The invention according to claim 8 in which said switch timer element comprises a switch timer circuit including a resistor and a capacitor in parallel.

10. The invention according to claim 9 in which the output circuit for each of said channel circuits comprises a relay including a relay coil connected to the capacitor in the corresponding switch timer circuit, and a return circuit connected to the resistor in said corresponding switch timer circuit, an output relay switch for each channel circuit operatively controlled by a corresponding relay coil, said interlock switch means comprising an interlock relay switch controlled by said relay coil in one channel circuit for opening and closing each of said other output circuits and for connecting a corresponding output circuit with the corresponding return circuit to discharge the capacitor through said resistor in said corresponding switch timer circuit, when said corresponding interlock relay switch opens its corresponding output circuit.

* * * * *